United States Patent [19]

Jacobson

[11] Patent Number: 4,632,479

[45] Date of Patent: Dec. 30, 1986

[54] SAFETY TERMINAL FOR ELECTRICAL EXTENSION CORD

[75] Inventor: Sol M. Jacobson, Floral Park, N.Y.

[73] Assignee: Gem Electric Manufacturing Co., Inc., Hauppauge, N.Y.

[21] Appl. No.: 208,572

[22] Filed: Nov. 20, 1980

[51] Int. Cl.[4] ..... H01R 13/44

[52] U.S. Cl. ..... 339/36

[58] Field of Search ..... 339/36, 40

[56] References Cited

U.S. PATENT DOCUMENTS

| | | | |
|---|---|---|---|
| 2,559,151 | 7/1951 | Getzoff | 339/36 |
| 2,610,999 | 9/1952 | Silver | 339/36 |
| 3,810,070 | 5/1974 | Ludwig | 339/36 |
| 4,094,569 | 6/1978 | Dietz | 339/40 |
| 4,206,957 | 6/1980 | Ludwig et al. | 339/40 |
| 4,257,659 | 3/1981 | Gibbs | 339/36 |
| 4,279,457 | 7/1981 | Nickence | 339/36 |

*Primary Examiner*—Joseph H. McGlynn

*Attorney, Agent, or Firm*—Kirschstein, Kirschstein, Ottinger & Israel

[57] ABSTRACT

A safety-type terminal for an electrical extension cord, which protects against electrical shock and burn, comprises an elongated, elastomeric, non-conductive body; pairs of internal female contact strips which are spaced apart longitudinally of the body; contact slots for each female contact strip spread apart transversely of the body; and prong-admitting passageways from the exterior surface of the body to the female contact strips. The terminal further comprises electrically non-conductive safety guards each of which is arranged in line and beneath the mouths of a different pair of female contact slots. The safety guards contain prong-passing openings, the spacing of which matches the spacing of the body passageways. The safety guards are independently mounted so that they can reciprocally slide transversely to the length of the body in response to manual manipulation by a user between stops which define: a closed position in which the openings of each safety guard are disaligned with the passageways of the body and the safety guard blocks entry of an electrical prong through said body passageways, and an open position in which the openings of each safety guard are aligned with the passageways of the body, to thereby permit entry of the prongs through said body passageways. Thus, the safety guards can be manipulated into a position which will prevent accidental insertion of objects into the body passageways when said passageways are not engaged by an electrical plug.

5 Claims, 5 Drawing Figures

SAFETY TERMINAL FOR ELECTRICAL EXTENSION CORD

BACKGROUND OF THE INVENTION

1. Field of the Invention

For an electric extension cord, a terminal having safety guards to protect against electrical shock and burn.

2. Description of the Prior Art

It long has been recognized that electrical outlets represent a source of danger for electrical shocks and burns. This hazard is more likely for young children who fail to appreciate the danger of inserting objects into the prong-admitting passageways that lead to the female contacts housed in electrical outlets. Small children due to inherent curiosity and imitative behavior insert metallic objects into these prong-admitting passageways and as a result are shocked or burned, sometimes seriously and occasionally fatally.

Many attempts have been made to make electrical receptacles safer by providing closure mechanisms that block the contact sockets when a plug is not engaged therein. One approach has been to provide a pseudo-twin prong plug for an electrical wall outlet, the same being totally composed of electrically nonconductive material; the bases of the prongs are connected by a bridge molded in one piece with the prongs. This device, although in wide use, does not totally remove the danger since children may manage to work out the bridge and prongs.

Another approach to the problem involves the use of a special wall outlet which replaces a standard wall outlet. The special wall outlet includes a disc rotatably mounted over a wall outlet casing and including a pair of passageways that normally are disaligned with the passageways of the wall outlet casing but which can, by revolving the disc, be brought into alignment with the casing passageways. The disc is spring-biased into its out-of-alignment position so that to successfully couple a twin-prong plug to the wall outlet, the tips of the prongs are inserted into the passageways of the disc, the disc rotated through an arc, usually 90°, with the aid of the plug, and the prongs then thrust home into the passageways of the casing until they engage the female contacts. This second approach requires more coordination and dexterity than is possessed by most children and, therefore, is quite effective. However, the structure of the special wall outlet is rather expensive so that the same has not proven to be highly salable.

There is also on the market—and this is not an item which has any connection with safeguarding a child against the danger of electrical shock or burns—a molded-on terminal for an electric extension cord. The molded-on terminal has largely replaced the now-antiquated hollow cube tap which had comprised a pair of mating shells containing within them female contacts that were secured to the twin leads of the extension cord. In the molded-on connectors access to the female contacts was provided by prong-admitting openings. The previous terminals employed rigid shells, for example, shells molded of a phenolformaldehyde condensation resin, e.g., Bakelite. However, the molded-on terminals are made of an elastomeric plastic, e.g., a polyvinylchloride, which is a semi-soft, semi-rigid material typically having a Shaw durometer in the vicinity of 40, the same being exemplificative.

The elasticity of such a terminal is employed in U.S. Pat. No. 3,810,070 to provide a biasing force that urges an external, slidable safety guard to blocking position. The patent discloses a system in which the prong-admitting passageways of the safety guard are normally disaligned with the prong-admitting passageways of the elastomeric connector. However, the guard which is mounted for sliding movement over a face of the connector can be forced into a position in which it distorts the connector and its prong-admitting passageways are aligned with the prong-admitting passageways of the connector.

SUMMARY OF THE INVENTION

1. Purposes of the Invention

It is an object of the invention to provide an improved terminal for an electric extension cord which terminal is not subject to the foregoing drawbacks.

It is another object of the invention to provide a terminal of the character described which includes quick, reliable, simple and inexpensive safety guards that can be manipulated selectively to block or expose different ones of plural prong-admitting passageways.

It is another object of the invention to provide a terminal of the character described which readily lends itself to mass production and easy, rapid assembly.

It is another object of the invention to provide a terminal of the character described which utilizes safety guards that cannot be removed by hand so that they become a permanent part of the terminal.

It is another object of the invention to provide a terminal of the character described which has safety guards that have manually manipulative portions accessible for opposite sides of said terminal.

It is another object of the invention to provide a terminal of the character described which has safety guards that contain indicia means for denoting the prevailing position of the guards.

Other objects of the invention in part will be obvious and in part will be pointed out hereinafter.

2. Brief Description of the Invention

A terminal is molded on to an end of an extension cord. The opposite end of the cord terminates in a twin-prong plug. The end of the cord on which the terminal is molded has pairs of female contact means attached thereto. The pairs of contact means are spaced apart longitudinally of the terminal body and the contact means of each pair are spread apart transversely of the body. These contacts are embedded into the body during molding. Also, during molding, passageways are formed for admitting prong into the terminal body.

Preferably, in accordance with current practices in the electrical art, the passageways molded into the connector body for admitting the prongs of a twin-prong plug are polarized, the type of polarization used being a standard one, to wit, one in which one prong-admitting passageway is wider than the other. Thus, such passageways will readily couple with the twin prongs of an appliance plug which are of two different widths in order to prevent any but the proper insertion, this being one in which the prong that through failure of insulation in an electrical appliance will be connected to the casing of such appliance is the prong which will engage the grounded female contact of the connector.

Electrically nonconductive, elongated, rectilinear safety guards of a stiff material, are mounted within the body of said terminal during molding. Mounting means defines a cavity for each safety guard in which the latter are snugly received, so that the safety guards will remain in any position to which they are manually slid. The safety guards are so positioned that each is arranged in line with and beneath the mouths of a different pair of female contacts. Each guard is provided with pairs of prong-passing openings, the spacings between which matches that of the passageways of the terminal body. Movement of the safety guards through the cavities is confined to a direction transverse to the length of the terminal body. The safety guards include stop means which limit the movement of each guard in the connector between two extreme positions, namely, (1) a closed position in which the openings of the safety guard are disaligned with the passageways in the body and thus the safety guard blocks movement of electrical prongs through the body passageways, and (2) an open position in which the openings of each safety guard are aligned with the passageways of the body, thus permitting free movement of electrical prongs through the body passageways.

Each mounted guard has manually manipulative portions at opposite ends of said guard. Each manually manipulative portion projects beyond the side surface of the terminal body to permit the user to press the proper portion and thus manually apply force to shift the guard from either position to the other.

As will be appreciated from the foregoing description, movements of the safety guards are accomplished by user manipulation.

Desirably the guards are so proportioned that the distance from either prong-admitting passageway to an adjacent edge of the guard exceeds the space between two prongs, thus preventing the insertion of ony one prong into a passageway in the guard and into the corresponding passageway of the connectory body which could lead to a mishap.

The invention accordingly consists in the features of construction, combinations of elements and arrangements of parts of which the scope of application will be indicated in the appended claims.

DESCRIPTION OF THE PREFERRED EMBODIMENT

Figure 1:
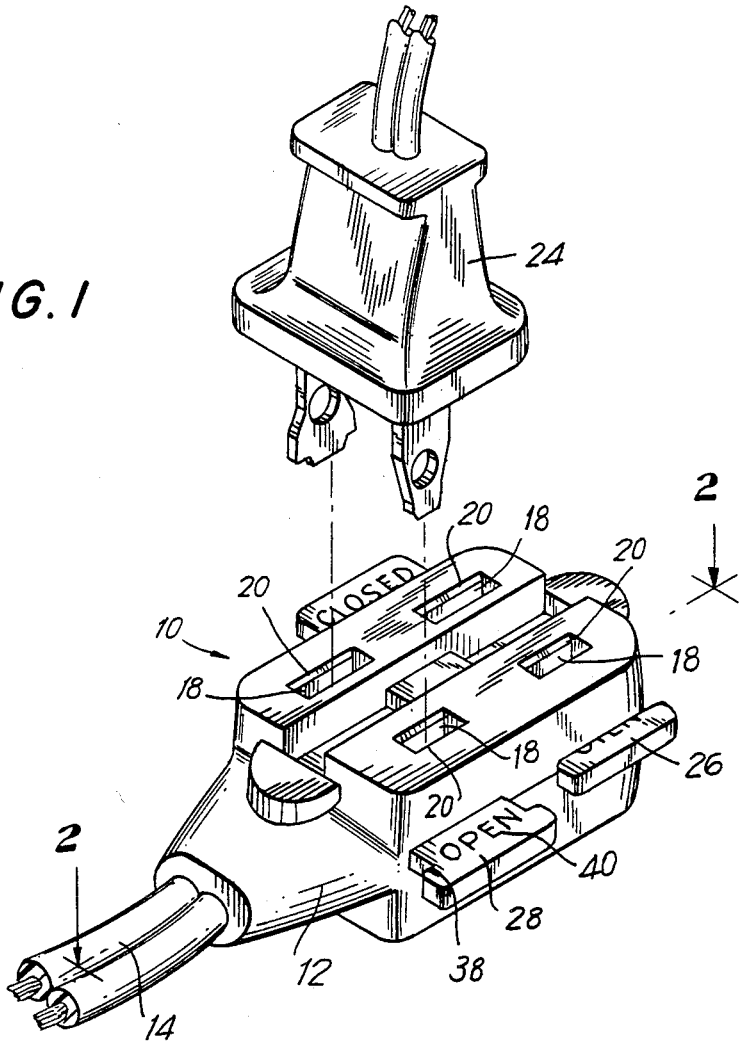
FIG. 1 is a perspective view of a terminal in accordance with this invention, together with a withdrawn electrical two-prong plug insertable into said terminal.

Referring now in detail to the drawings, the reference numeral 10 denotes a safety type terminal embodying the present invention. Said terminal includes an elongated terminal body 12 that is generally solid and is fabricated of a electrically nonconductive material.

The terminal body is molded around one end of a twinwire electrical cord 14 which is provided with a conventional two-prong plug for insertion into an electrical outlet such as a wall outlet.

The end of the cord 14 around which the terminal body 12 is molded has attached to the electrically conductive wires thereof pairs of electrically conductive female contact strips 16 embedded within the terminal body 12. The pairs of female contact strips 16 are spaced apart longitudinally of the terminal body 12 and the contact slots of each pair 17 are spaced apart transversely of the body 12. Moreover, during the process of molding, prong-admitting passageways 18 are provided, which extend from their mouths 20 on an exterior surface of the terminal body to and beyond prong-engaging slots 22 formed in the female contact strips (see FIG. 5). The molding of terminal bodies around female contacts in the manner just described is well known and is currently conventionally employed in connection with terminal bodies not having safety guards.

Any suitable molding procedure may be practiced which permits the female contacts and associated end of cord 24 to be embedded into the connector body and suitable pins are employed to form the passageways 18 during the molding process.

Although the same is not critical to the present invention, the prong-admitting passageways 18 are polarized, that is to say, they are different from one another in some respect. The purpose of polarization is to ensure that the prong of an application which is or may be connected by failure of insulation to the casing of the applicance engages that female contact which is grounded, that is to say, is so connected in the house circuit that this contact is at ground potential. This prevents the appliance casing from accidentally having a high potential applied thereto, as for example, by failure of insulation within the appliance. Various types of polarizing arrangements can be employed, although only one is shown in the terminal 10. One type of polarizing arrangement which is not presently favored is to have the passageways 18, which are of oblong transverse cross-section, arranged so that the longitudinal axis of one such cross-section is perpendicular to the longitudinal axis of the other. The prongs designed to be admitted into such passageways have a corresponding angular orientation and, therefore, only can be inserted in one manner, thus ensuring the proper type of engagement as mentioned above. However, it is now accepted practice in the United States household electrical field to have appliances provided with twin-prong plugs, the prongs of which, likewise of oblong cross-section, have the longitudinal axes of the cross-sections parallel to one another. Hence the prong-admitting passageways of connectors designed to be engaged by such plugs likewise have the prong-admitting passageways (of oblong cross-section) arranged with their longitudinal axes parallel. Thereby, it is possible to insert the prongs incorrectly. To prevent this and still retain the parallelism of the passageways, present-day plugs are polarized by having one plug wider than the other, and, to cooperate with such plugs, prong-admitting passageways of electrical outlets, e.g., electrical outlets in connectors of extension cords, likewise have the prong-admitting passageways of different widths, thus ensuring proper connection with the household power supply.

In the illustrated embodiment of the invention, the prong-admitting passageways are of different widths, as best shown in FIG. 1, to cooperate with a similarly polarized twin-prong plug 24.

Pursuant to the present invention, safety guards 26 and 28 are provided which will prevent a person, and particularly a child, from deliberately or accidentally inserting an electrically conductive object into a terminal body passageway 18 and thereby subjecting himself to an electric shock or burn, and also will prevent a child from being burned if the child inserts the connector in his mouth.

The safety guards are elongated, flat, thin and rectilinear and, preferably, of a stiff electrically non-conductive material.

Figure 4:
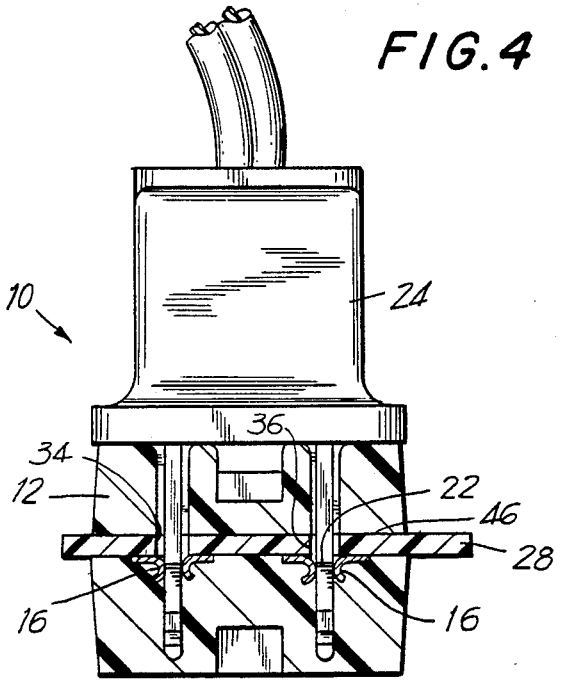
FIGS. 4 and 5 are cross-sectional views taken substantially along the lines 4—4 and 5—5, respectively, of FIG. 2
Figure 5:
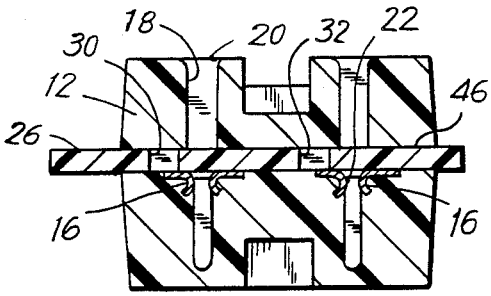

The safety guards have prong-passing openings 30, 32, 34, 36, the spacing of which matches that of the passageways in the terminal body 18. The prong-passing openings 30, 32, 34, 36 like the terminal body passageways 18, are polarized to match the polarized configuration of the blades of the plug 24. The safety guards have stop means 38 defining a closed position in which the prong-passing openings are disaligned with the terminal body passageways, thus creating a situation in which the safety guard blocks entry of objects through said body passageways and an open position in which the prong-passing openings of the safety guard are aligned with the passageway of the terminal body thereby permitting insertion of objects through said passageways. The closed position is best illustrated in FIG. 5. The open position is best illustrated in FIG. 4.

In the closed position of the safety guard, due to the fact that it is not possible to insert an electrically conductive element into the passageways 18 a person, particularly a child, is protected from the possible hazard of electrical shock or burns caused by such an insertion. Moreover, if a child should place a terminal in his mouth, a liquid conductive path would not readily be formed between a femal contact strip 16 and the child's mouth, such pathway being blocked by the safety guard.

If it is desired deliberately to insert the prongs of an appliance plug such as the plug 24, into the terminal so as to electrically engage the female contact strips 16, the safety guard is shifted by manual manipulation to align the openings in the guard 30, 32, 34, 36 with the terminal passageways 18 thereby permitting the prongs to be thrust into the terminal body and complete electrical coupling.

The safety guards have manually manipulative portions 40 on opposite ends of the guard, each manually manipulative portion projecting beyond the side surface of the terminal body 12 to permit the user to press the proper such protion on which to manually apply force.

The manually manipulative portions 40 of the safety guards contain indicia means 42, 44 for indicating the prevailing position of the safety guard.

The safety guards are independently mounted within the terminal body 12 for reciprocal sliding movement relative thereto transversely to the length of the terminal body 12 in response to manual manipulation. Each safety guard is independently mounted within a different cavity 46 for snugly receiving it, so that the safety guard will remain in any position to which it is manually slid. The cross-sectional dimensions of the mounting cavity 46 are such that they are only slightly larger than the width and depth of the safety guards thereby creating an amount of friction sufficient to prevent movement of the guards in the absence of manual manipulation by a user.

The pressure required to shift the safety guard transversely through the length of the terminal body is relatively mild. It is a pressure which can be exerted by an adult's finger without undue strain. In this manner the safety guard is so confined that it can experience a transverse sliding motion relative to the terminal body in two directions between two stop means 38 defining the afore-discussed two positions.

Each female contact strip 16 is formed with three slots 17, the contact means in the female contact strips being transversely registered with one another so that there effectively are provided three pairs of female contacts spaced apart from one another longtitudinally of the terminal body 12. Each pair of such contacts is designed to be engaged by the twin prongs of an electric plug. As is well known in the art, the slots in the female contacts are so shaped that the two pairs of endmost slots are designed to receive the prongs of plugs thrust into the terminal body from one face thereof, and the third pair of slots, which are intermediate slots, is designed to receive a plus inserted in the terminal body from the opposite face. All of the slots and their associated passageways 18 are identically constructed and function in the same manner.

Figure 2:
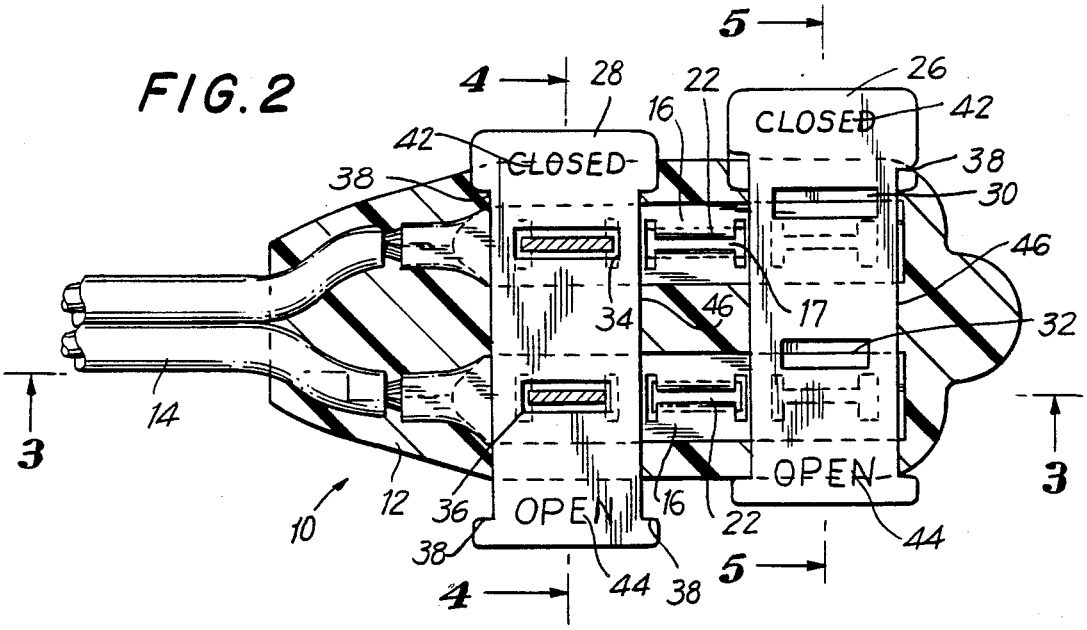
FIG. 2 is a horizontal sectional view taken substantially along the line 2—2 of FIG. 1, with the plug inserted.
Figure 3:
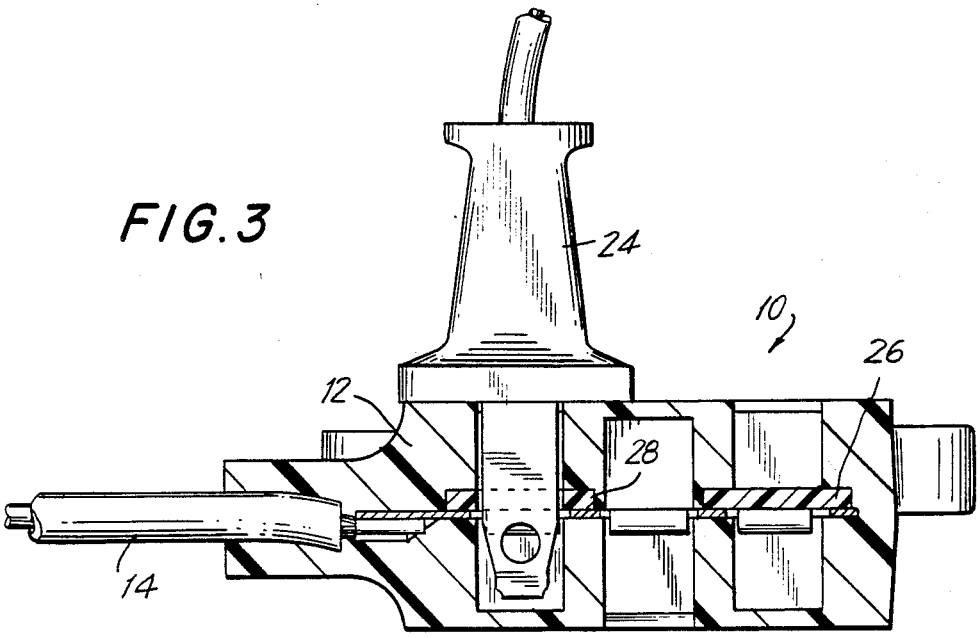
FIG. 3 is a vertical sectional view taken substantially along the line 3—3 of FIG. 2.

Each safety guard 26 and 28 acts independently of the other and blocks off only one pair of slots 17 with its associated passageway 18 when the safety guard is in the closed position. Thus it is possible to have one safety guard in the open positionready to admit the prongs of a plug 24 and another safety guard in the closed position, blocking off access to the mouths of the female contact, the slots 17 and the associated passageways 18. This is best illustrated in FIGS. 2 and 3.

It thus will be seen that there is provided a device which achieves the various objects of the invention and which is well adapted to meet the conditions of practical use.

As various possible embodiments might be made of the above invention, and as various changes might be made in the embodiment above set forth, it is to be understood that all matter herein described or shown in the accompanying drawings is to be interpreted as illustrative and not in a limited sense.

Having thus described the invention there is claimed as new and desired to be secured by Letters Patent:

1. A safety type terminal for an electrical extension cord, said terminal comprising:

an elongated body of electrically non-conductive elastomeric material;

pairs of female contact means of electrically conductive material located within said body, the pairs of contact means being spaced apart longitudinally of the body and the contact means of each pair being spaced apart transversely of the body;

means providing pairs of prong-admitting passageways from their mouths on an exterior surface of said body to said pairs of female contact means located internally of said body;

said terminal further including elongated rectilinear safety guards of electrically nonconductive stiff material, each of which is arranged in line with and beneath the mouths of a different pair of contact means;

means providing pairs of prong-passing openings through said safety guards, the spacing between said openings matching the transverse spacing between the passageways of the body for each pair of female contact means;

means independently mounting said safety guards within said body for non-biased reciprocal sliding movement relative thereto transversely to the length of the body in response to manual manipulation by a user between stop means defining:

a closed position of said safety guards in which the openings of each safety guard are disaligned with the passageways of the body and the safety guard blocks passage of electrical prongs through said body passageways and into engagement with said female contact means, and an open position of said safety guards in which the openings of each safety guard are aligned with the passageways of said body, to thereby permit passage of electrical prongs through said body passageways and into engagement with said female contact means;

said mounting means defining a cavity within the body for each safety guard and spaced by said body from the exterior surfaces of said body, each said cavity snugly and frictionally receiving the associated safety guard, so that the safety guards will remain in any position in the body to which they manually are slid; and each safety guard having manually manipulative portions on opposite ends thereof, each such portion projecting beyond the side surface of said body to permit the user to press the proper such portion.

2. A safety type terminal as set forth in claim 1, wherein the stop means comprises shoulders on the manually manipulative portion of the safety guards, one of said shoulders defining the open position when abutting against the terminal body and the other of said shoulders defining the closed position when abutting against the exterior wall of the terminal body.

3. A safety type terminal as set forth in claim 1, wherein there are three pairs of prong-admitting passageways in the terminal body, and two safety guards, said two safety guards arranged to be capable of blocking entry of plug prongs into the endmost body passageways.

4. A safety type terminal as set forth in claim 1 wherein the safety guards contain indicia means for indicating the prevailing position.

5. A safety type terminal as set forth in claim 4 wherein the indicia means consist of the word "open", and the word "closed", on the appropriate end portions.

* * * * *